US005165508A

United States Patent [19]

Kim

[11] Patent Number: 5,165,508

[45] Date of Patent: Nov. 24, 1992

[54] LUGGAGE CASE WITH PULL HANDLE

[75] Inventor: Hyun S. Kim, Newcastle, Pa.

[73] Assignee: Airway Industries, Inc., Ellwood City, Pa.

[21] Appl. No.: 812,724

[22] Filed: Dec. 23, 1991

[51] Int. Cl.[5] ..... A45C 13/26

[52] U.S. Cl. ..... 190/115; 190/122; 190/127

[58] Field of Search ..... 190/18 A, 39, 115, 122, 190/127

[56] References Cited

U.S. PATENT DOCUMENTS

| | | | |
|---|---|---|---|
| 2,042,387 | 5/1936 | Cobb | 190/18 A |
| 2,392,926 | 7/1943 | Kelly . | |
| 2,581,417 | 1/1952 | Jones . | |
| 2,585,209 | 2/1952 | Abbott . | |
| 2,804,900 | 9/1957 | Lifton | 190/122 |
| 3,592,314 | 7/1971 | Jacobson | 190/122 |
| 3,805,929 | 4/1974 | Kuwayama | 190/115 |
| 4,299,313 | 11/1981 | Null | 190/115 |
| 4,418,804 | 12/1983 | Bradley et al. | 190/18 A |
| 4,813,520 | 5/1989 | Lin . | |
| 4,838,396 | 6/1989 | Krenzel | 190/18 A |
| 4,873,841 | 10/1989 | Bradshaw et al. . | |
| 4,890,705 | 1/1990 | Pineda . | |
| 4,955,487 | 2/1991 | Plath . | |
| 4,966,259 | 10/1990 | Bergman | 190/115 |
| 5,048,649 | 9/1991 | Carpenter et al. . | |

*Primary Examiner*—Gary E. Elkins
*Attorney, Agent, or Firm*—Walter J. Blenko, Jr.

[57] ABSTRACT

A suitcase having a pull handle. The pull handle is rotatably affixed to the suitcase with a bracket element to assist the user of the suitcase in pulling same across a flat surface with substantially no fishtailing.

8 Claims, 2 Drawing Sheets

LUGGAGE CASE WITH PULL HANDLE

FIELD OF THE INVENTION

The present invention relates to luggage, and particularly to luggage having a pull handle to enable the user to pull the luggage across smooth surfaces, such as airport walkways and the like.

DESCRIPTION OF THE PRIOR ART

Conventional suitcases, luggage, baggage, and the like available on the market may generally be grouped into three types: rigid, semi-rigid, and collapsible.

Rigid luggage is generally nondeformable on every surface thereof, offering the advantage of durability and maximum protection for the contents contained therein. Semi-rigid luggage generally is fashioned from a series of pliable sides supported by inner rib members which provide shape and strength to the luggage. Collapsible baggage may include duffle-bag-type luggage having no internal supports or luggage of the type discussed in U.S. Pat. No. 4,813,520 having removable external supports, which may be folded for minimizing storage space when the collapsible baggage is not in use.

A common problem, typical of large sizes of luggage, is the tendency of the luggage to hold more weight than can be effectively or comfortably carried by hand over long distances. Several means of alleviating this problem have been developed, including folding luggage carts, and the use of rollers or casters on the bottom surface of the luggage coupled with a leash or strap or other means for pulling the luggage across a surface.

Such devices typically result in a piece of luggage that is difficult to control, however, especially in the frenetic environment in which such devices typically are used, such as airports, taxi stands, crowded sidewalks and the like. One frequent problem is the tendency of wheeled luggage to "fishtail" whereby the luggage deviates from a straight path and sways back and forth, and in the extreme case wobbles and falls over on its side.

SUMMARY OF THE INVENTION

The present invention solves the above problems of the prior art by providing a suitcase having spaced, generally parallel front and back sides connected about their periphery to a peripheral wall member extending between the front and back sides thereby defining a volume. A stiff spine may be affixed to the wall member around the periphery thereof, this spine providing support to the wall member. Optionally, the wall member may itself act as a stiff spine for purposes of the invention. The invention further includes a rigid pull handle connected to the spine at separated points positioned transversely of the spine, the pull handle being pivotally mounted on an axis transverse to the spine and rotatable about that axis between a pulling position in which the handle extends outwardly from the suitcase and a storage position in which the handle is in juxtaposition to the peripheral wall member. The handle permits the suitcase to be pulled across a surface substantially without fishtailing when the handle is in the pulling position.

BRIEF DESCRIPTION OF THE DRAWINGS

A full understanding of the invention can be gained from the following description of the preferred embodiment when read in conjunction with the accompanying drawings in which.

DESCRIPTION OF THE PREFERRED EMBODIMENTS

Figure 1:
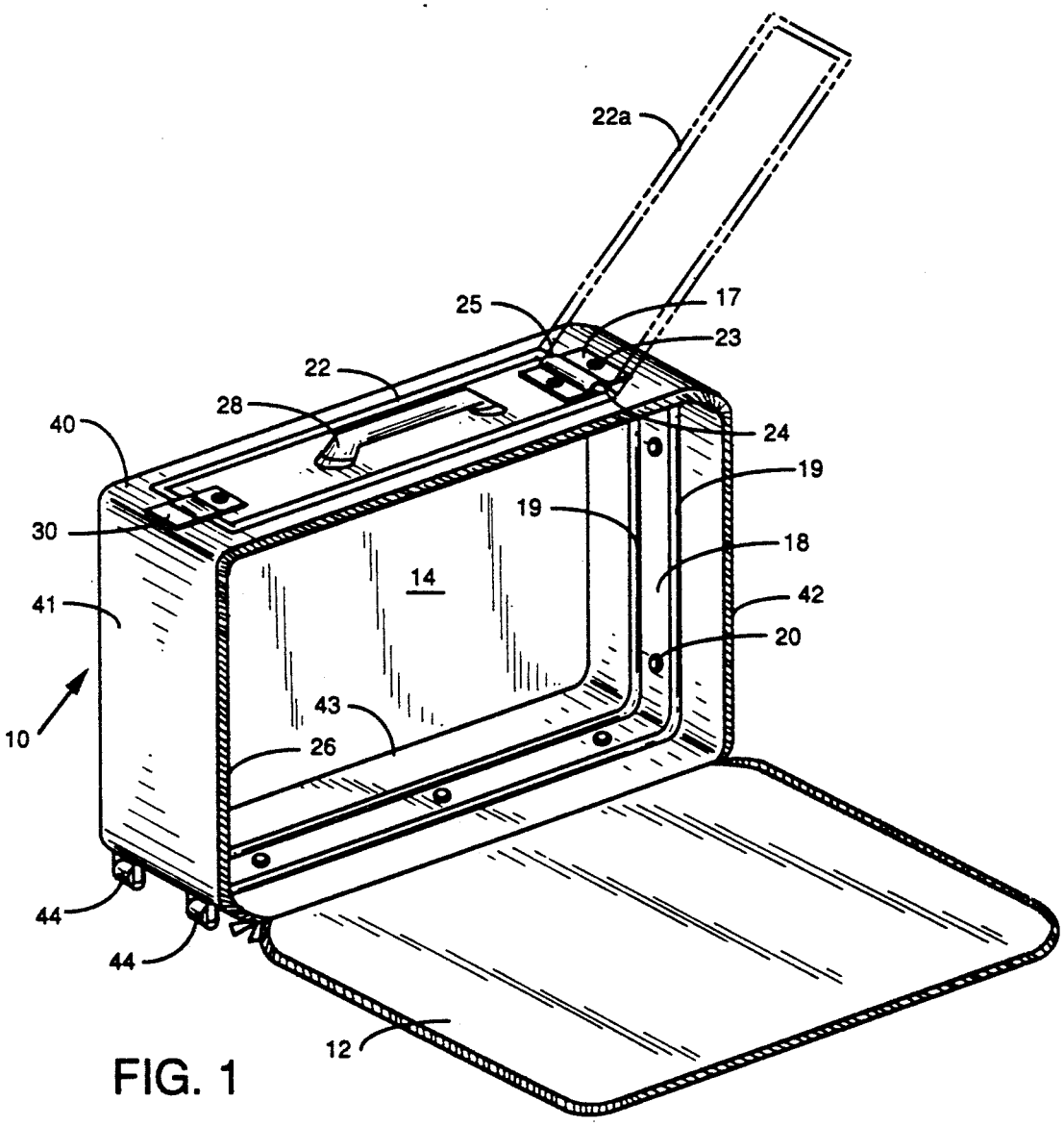
FIG. 1 is an isometric perspective view of a preferred embodiment of the invention.

Referring to FIG. 1 there is illustrated an opened suitcase generally 10 comprising a front side 12 and a back side 14 having a peripheral wall member 16 connected about the periphery of the front and back sides and extending between the front and back sides thereby defining volume in the suitcase, the volume being contained when the front side 12 is closed.

The suitcase 10 illustrated in FIG. 1 comprises a semi-rigid suitcase, fabricated of, for example, a polymeric material and/or fabric, such as reinforced nylon. The embodiment of FIG. 1 includes a spine 18 which is affixed to the peripheral wall member 16 and extends around the periphery thereof. The spine 18 is a generally rigid material, such as PVC, aluminum, and the like, and may include a pair of stiffening ribs 19 to add further support to the spine 18. The spine is affixed to the wall member 16 by a plurality of fasteners 20, which may comprise rivets or any other fastening means known to those skilled in the art.

Alternatively, the spine 18 may comprise the entire peripheral wall member 16, as would generally be the case when a rigid suitcase 10 is provided. In such case, the front and back sides and peripheral wall member therebetween comprise a rigid material, such as metal sheet, the wall section of a molded shell, reinforced fabric, heavy-duty plastic, and any other rigid material well known to those skilled in the art.

Consequently, as used herein, the term "spine" refers to and includes both a separate spine member 18 fastened to a semi-rigid or flaccid peripheral wall member 16, as well as a rigid wall member 16 which extends between the front and back sides 12 and 14.

As also seen in FIG. 1, the preferred embodiment of the invention includes a pull handle 22 which is connected to the spine 18 at separated points 24 and 25. The pull handle 22 preferably comprises a rigid material, such as steel or aluminum rod and may be covered in a soft fabric or other aesthetic material.

The separated points 24 and 25 allow the handle 22 to be rotated about an axis transverse to the spine as illustrated by the phantom lines representing the handle in a pull position **22*a*, in which the handle extends outwardly from the suitcase to allow the suitcase 10 to be pulled across a surface. The rotatable handle may likewise be rotated into a storage position 22 in which the handle is in juxtaposition to the peripheral wall member 16 as illustrated. Optionally, the suitcase 10 may be provided with a retaining means 30 for retaining the handle 22** in the storage position.

Figure 2:
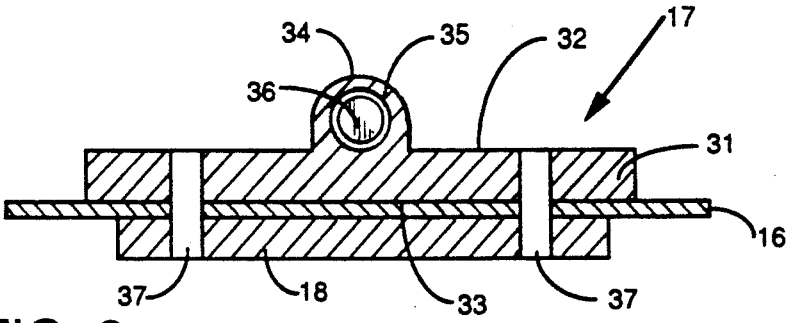
FIG. 2 is a cross sectional view of a bracket of the invention as attached to a spine of a suitcase.
Figure 3:
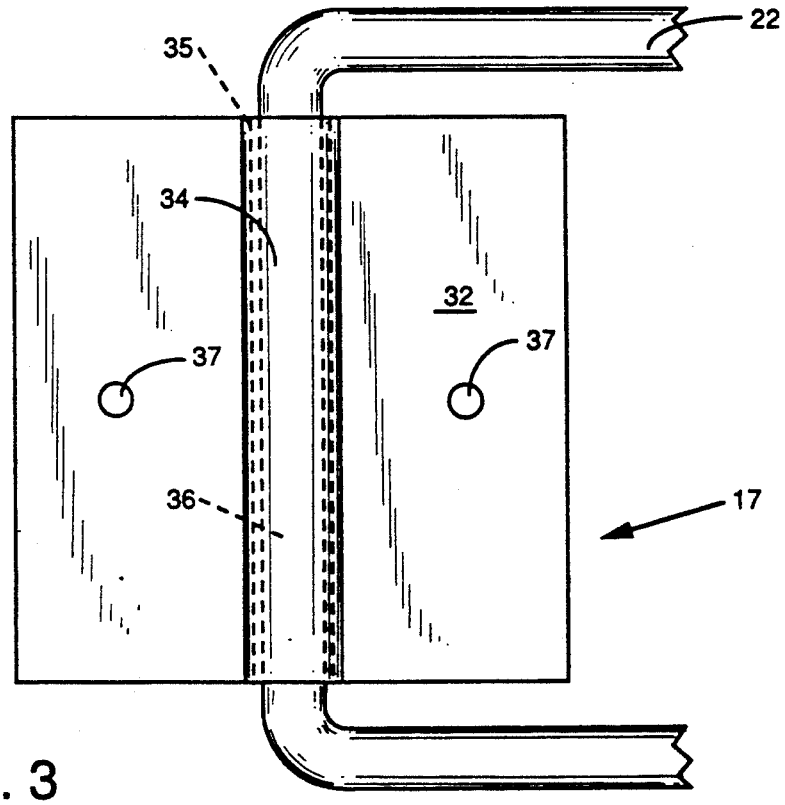
FIG. 3 is a plan view of the bracket of FIG. 2.

As further illustrated in FIGS. 1, 2, and 3, the pull handle 22 is pivotally connected to a bracket means 17 which is connected to the spine 18, for example with one or more fasteners 23. Because the bracket 17 extends in a transverse direction relative to the spine 18, and because the pull handle 22 is rotatably connected to the bracket 17, when the pull handle **22*a* is pulled, the load contained in the suitcase tends to be transferred evenly across the spine 18. Because the handle 22 is rigid, and separated by a distance represented by the separated points 24 and 25, the suitcase tends to follow a straight path when pulled, and avoids fishtailing. If a fishtailing tendency is sensed by the user of the pull handle, the rigidity of the handle and secured fastening of the handle 22 to the bracket 17** allow the user to quickly correct the situation.

The bracket 17 of FIGS. 2 and 3 includes a plate 31 having a top surface 32 and a bottom surface 33. In one embodiment of the invention, the top surface 33 has affixed thereto or integral therewith a flange 34 having a passage 35 therethrough for receiving a pivot rod 36 therethrough. The pivot rod 36 has two ends which extend out either side of the flange 34 and attached to the pull handle, thereby defining the two separated points 24 and 25 discussed previously. The bracket means 17 may further include one or more holes 37 therethrough for fastening the bracket 17 to the suitcase 10. Preferably, the bracket 17 is fastened to the spine 18 at least at two points 23 in order to more securely fasten the bracket 17 to the suitcase.

The suitcase 10 of FIG. 1 comprises a semi-rigid suitcase in which the front side 12 and back side 14 are of a relatively soft material, such as reinforced nylon. This embodiment further preferably includes a slide fastener 26 for securely closing the front side 12 about its periphery to the wall member 16. In this embodiment, the rigid spine 18 is secured to the wall member 16 between the front and back sides 12 and 14 and most preferably is substantially equally spaced between the front and back sides 12 and 14.

The suitcase 10 of FIG. 1 comprises a four-sided wall member 16 having a top side 40, a left side 41, a right side 42, and a bottom 43 connected at four corners. Most preferably, the bottom 43 is rigid across the entire area thereof, and fixed with a series of rolling means 44, such as casters, wheels, rollers, etc., known to those skilled in the art. The top side 40 may further include a carrying handle 28 fastened to the top side for carrying the suitcase, the pull handle being adapted to be secured out of the way to facilitate use of the carrying handle 28. In the embodiment of FIG. 1 the carrying handle 28 passes through the opening in the pull handle 22 when the pull handle is in the storage position and retained by the retaining means 30.

It will be readily appreciated by those skilled in the art that the bracket 17 should have an appreciable width to maximize the control over fishtailing when the suitcase 10 is pulled across a surface. In general, the narrower the bracket 17, the less the amount of control over a fishtailing suitcase.

Figure 4:
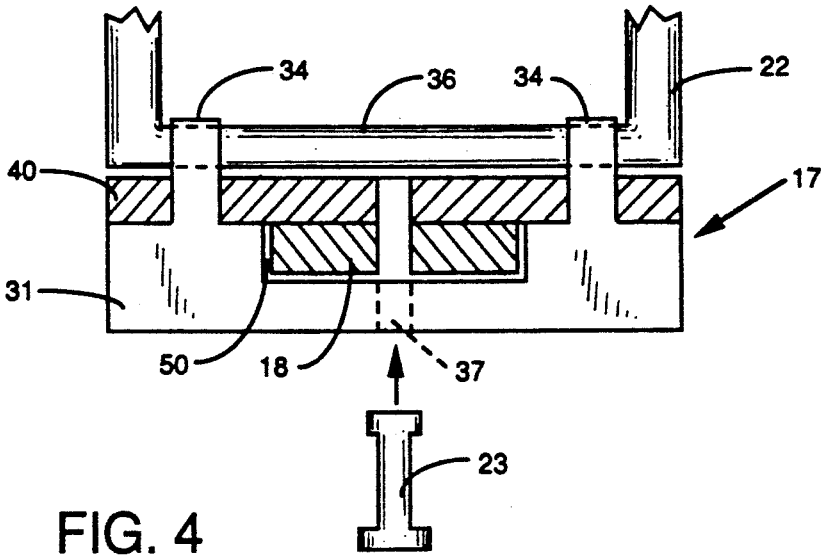
FIG. 4 is a cross sectional view of another bracket of the invention attached to a spine of a suitcase.

Another embodiment of the invention is illustrated in FIG. 4. In this embodiment, the bracket 17 is positioned below the suitcase top side 40, and has a pair of sockets 34 extending through the top side 40. These sockets receive the pivot rod 36 of the handle 22 therethrough as illustrated. The embodiment of FIG. 4 may be fastened to the spine 18 by a fastener 23 passing through a hole 37 communicating with the bracket 17, spine 18, and top side 40 as illustrated. In this embodiment, only one fastener 23 need be used because the bracket 17 derives lateral stability from the spine 18 itself, being positioned within a grove 50 in the bracket 17.

Alternatively, the bracket 17 may be recessed within the top side 40 so the bracket 17 does not protrude above the top side 40, including, for example, sockets built into the top side or the bracket for rotatably receiving the handle 22. Additionally, the bracket need not be affixed to the top side 40, but may be conveniently affixed to the spine 18 on the left side 41 or right side 42 of the peripheral wall member 16.

The retaining means 30 may comprise a strap having velcro, snaps, buckles, or any other suitable fastening means for maintaining the handle 22 in a storage position as illustrated. Optionally, the retaining means 30 may comprise a groove-and-snap configuration built into the wall member 16 to securely retain the handle 22 in the storage position.

Whereas particular embodiments of the invention have been described herein, for purposes of illustration, it would be evident to those skilled in the art that numerous variations of the details may be made without departing from the invention as defined in the appended claims.

I claim:

1. A suitcase having spaced, generally parallel front and back sides connected about their periphery to a peripheral wall member extending between the front and back sides thereby defining a volume, a spine affixed to the wall member around the periphery thereof, the spine providing support to the wall member, a rigid pull handle connected to the spine at separated points positioned transversely of the spine, the pull handle being pivotally mounted on an axis transverse to the spine and rotatable about that axis between a pulling position in which the handle extends outwardly from the suitcase and a storage position in which the handle is in juxtaposition to the peripheral wall member, the handle permitting the suitcase to be pulled across a surface substantially without fishtailing when the handle is in the pulling position.

2. The suitcase of claim 1 wherein the pull handle is pivotally mounted on bracket means connected to the spine, the bracket transferring a pulled load transversely of the spine.

3. The suitcase of claim 1 wherein the front and back sides are soft and the front side periphery includes a glide fastener for closing and opening the suitcase.

4. The suitcase of claim 1 wherein the wall member comprises four sides connected at four corners, one side comprising a rigid bottom, the rigid bottom including rolling means secured thereto for rolling the suitcase across a surface.

5. The suitcase of claim 1 wherein the spine is disposed about the peripheral wall member substantially equidistant between the front and back sides.

6. The suitcase of claim 1 wherein one of the wall member sides comprises a top side, the suitcase further including a carry handle fastened to the top side for carrying the suitcase, the pull handle being adapted for secured storage on the top side, the carry handle passing through an opening in the pull handle when the pull handle is in the storage position, the pull handle being retained in the storage position by a retaining means on the top side.

7. The suitcase of claim 4 wherein the bracket means comprises a plate having a top surface and a bottom surface, the plate having connected to its top surface a flange for rotatably receiving the pull handle, the flange receiving a pivot rod therethrough, the pivot rod having two ends comprising the separated points, by which the pull handle is pivotally attached to the bracket means.

8. The suitcase of claim 7 wherein the bracket means is mounted on the top side, and the plate is fastened to the spine at least at two points.

* * * * *